US008570045B2

(12) United States Patent
Tchakarov et al.

(10) Patent No.: US 8,570,045 B2
(45) Date of Patent: Oct. 29, 2013

(54) DRILLING SYSTEM FOR MAKING LWD MEASUREMENTS AHEAD OF THE BIT

(75) Inventors: Borislav J Tchakarov, Humble, TX (US); Stephen D Bonner, Sugarland, TX (US); Ricki Marshall, Houston, TX (US); Treston Davis, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 437 days.

(21) Appl. No.: 12/557,113

(22) Filed: Sep. 10, 2009

(65) Prior Publication Data

US 2011/0057656 A1 Mar. 10, 2011

(51) Int. Cl.
*G01V 3/00* (2006.01)

(52) U.S. Cl.
USPC ..... 324/369; 324/324; 324/368; 324/356

(58) Field of Classification Search
USPC ..... 324/323–375; 250/253–266; 343/703, 343/709, 718–719; 166/244.1–403; 173/152.01–152.62; 367/1–86; 175/1, 175/40–50; 702/1–199
See application file for complete search history.

(56) References Cited

U.S. PATENT DOCUMENTS

| | | | | |
|---|---|---|---|---|
| 5,235,285 | A | 8/1993 | Clark et al. | |
| 5,473,158 | A | 12/1995 | Holenka et al. | |
| 5,984,023 | A | 11/1999 | Sharma et al. | |
| 6,230,822 | B1 | 5/2001 | Sullivan et al. | |
| 6,359,438 | B1 | 3/2002 | Bittar | |
| 6,814,162 | B2 | 11/2004 | Moran et al. | |
| 6,850,068 | B2 | 2/2005 | Chemali et al. | |
| 7,027,926 | B2 | 4/2006 | Haugland | |
| 7,074,064 | B2 | 7/2006 | Wallace | |
| 7,168,508 | B2 | 1/2007 | Goldberg et al. | |
| 7,293,613 | B2 | 11/2007 | Goldberg et al. | |
| 7,303,007 | B2 | 12/2007 | Konschuh et al. | |
| 7,388,380 | B2 * | 6/2008 | Chen et al. | 324/347 |
| 7,436,184 | B2 | 10/2008 | Moore | |
| 7,554,329 | B2 * | 6/2009 | Gorek et al. | 324/369 |

(Continued)

FOREIGN PATENT DOCUMENTS

| | | | |
|---|---|---|---|
| EP | 1434063 | A2 | 6/2004 |
| EP | 1933003 | A1 | 6/2008 |

OTHER PUBLICATIONS

Weller, G, et al. "A new integrated LWD platform brings next-generation formation evaluation services"; SPWLA 46th Annual Logging Symposium, New Orleans, LA, Jun. 26-29, 2005.
International Search Report and Written Opinion for corresponding PCT application No. PCT/US2010/048389 filed Sep. 10, 2010.

*Primary Examiner* — Patrick Assouad
*Assistant Examiner* — Alesa Allgood
(74) *Attorney, Agent, or Firm* — Kimberly Ballew

(57) ABSTRACT

A drilling system includes integral drill bit body and logging while drilling tool body portions. There are no threads between the drill bit and the LWD tool. In one exemplary embodiment the drilling system includes a unitary tool body, i.e., a tool body formed from a single work piece. In another exemplary embodiment the drill bit body portion is welded to the LWD tool body portion. At least one LWD sensor is deployed in the drill bit. The drilling system enables multiple LWD sensors to be deployed in and near the bit (e.g., on both the side and bottom faces of the bit). The absence a threaded connection facilitates the placement of electrical connectors, LWD sensors, and electronic control circuitry at the bit.

43 Claims, 12 Drawing Sheets

(56) References Cited

U.S. PATENT DOCUMENTS

| | | | | |
|---|---|---|---|---|
| 7,558,675 | B2 | 7/2009 | Sugiura | |
| 7,743,654 | B2 * | 6/2010 | Spross et al. | 73/152.03 |
| 7,921,937 | B2 * | 4/2011 | Brackin et al. | 175/24 |
| 2004/0104726 | A1 | 6/2004 | Chemali et al. | |
| 2007/0186639 | A1 | 8/2007 | Spross | |
| 2008/0066581 | A1 * | 3/2008 | Zahradnik et al. | 76/108.4 |
| 2008/0164062 | A1 | 7/2008 | Brackin | |

* cited by examiner 10
12
20
30
18
22
16
40
100

DRILLING SYSTEM FOR MAKING LWD MEASUREMENTS AHEAD OF THE BIT

RELATED APPLICATIONS

None.

FIELD OF THE INVENTION

The present invention relates generally to a drilling system for making logging while drilling measurements at and/or ahead of the bit. In particular, embodiments of the invention relate to a drilling system including an integral drill bit and logging while drilling tool.

BACKGROUND OF THE INVENTION

Logging while drilling (LWD) techniques for determining numerous borehole and formation characteristics are well known in oil drilling and production applications. Such logging techniques include, for example, gamma ray, spectral density, neutron density, inductive and galvanic resistivity, micro-resistivity, acoustic velocity, acoustic caliper, physical caliper, downhole pressure measurements, and the like. Formations having recoverable hydrocarbons typically include certain well-known physical properties, for example, resistivity, porosity (density), and acoustic velocity values in a certain range. Such LWD measurements (also referred to herein as formation evaluation measurements) are commonly used, for example, in making steering decisions for subsequent drilling of the borehole.

LWD sensors (also referred to in the art as formation evaluation or FE sensors) are commonly used to measure physical properties of the formations through which a borehole traverses. Such sensors are typically, although not necessarily, deployed in a rotating section of the bottom hole assembly (BHA) whose rotational speed is essentially the same as the rotational speed of the drill string. LWD imaging and geosteering applications commonly make use of focused LWD sensors and the rotation (turning) of the BHA during drilling of the borehole. For example, in a common geo-steering application, a section of a borehole may be routed through a thin oil bearing layer (sometimes referred to in the art as a payzone). Due to the dips and faults that may occur in the various layers that make up the strata, the drill bit may sporadically exit the oil-bearing layer and enter nonproductive zones during drilling. In attempting to steer the drill bit back into the oil-bearing layer (or to prevent the drill bit from exiting the oil-bearing layer), an operator typically needs to know in which direction to turn the drill bit (e.g., up or down). Such information may be obtained, for example, from azimuthally sensitive measurements of the formation properties.

In recent years there has been a keen interest in deploying LWD sensors as close as possible to the drill bit. Those of skill in the art will appreciate that reducing the distance between the sensors and the bit reduces the time between cutting and logging the formation. This is believed to lead to a reduction in formation contamination (e.g., due to drilling fluid invasion) and therefore to LWD measurements that are more likely to be representative of the pristine formation properties. In geosteering applications, it is further desirable to reduce the time (latency) between cutting and logging so that steering decisions may be made in a timely fashion.

One difficulty in deploying LWD sensors at or near the drill bit is that the lower BHA tends to be particularly crowded with essential drilling and steering tools, e.g., often including the drill bit, a near-bit stabilizer, and a steering tool all threadably connected to one another. LWD sensors commonly require complimentary electronics, e.g., for digitizing, preprocessing, saving, and transmitting the sensor measurements. These electronics are preferably deployed as close as possible to the corresponding sensors so as to minimize errors due to signal transmission noise and cross coupling. While the prior art does disclose the deployment of sensors in the drill bit (e.g., U.S. Pat. No. 6,850,068 to Chemali et al and U.S. Pat. No. 7,554,329 to Gorek et al) there is no suggestion as to how the above described problems can be overcome. Therefore, there is a need in the art for an improved drilling system that addresses these problems and includes a drill bit with at least one LWD sensor deployed therein.

SUMMARY OF THE INVENTION

Aspects of the present invention are intended to address the above described need for improved drilling systems. Exemplary embodiments in accordance with the present invention include a drilling system including integral drill bit and logging while drilling tool portions. There are no threads between the drill bit and the logging while drilling tool portion. In one exemplary embodiment the drilling system includes a unitary tool body, i.e., a tool body formed from a single work piece. In another exemplary embodiment the drilling system includes an integral tool body in which a drill bit body portion is welded to a logging while drilling tool body portion. Embodiments in accordance with the invention further include at least one logging while drilling sensor deployed in the drill bit. Preferred embodiments include a plurality of electrical current sensing electrodes deployed on a cutting face and a lateral face of the drill bit.

Exemplary embodiments of the present invention may provide several technical advantages. For example, drilling systems in accordance with the invention tend to enable a plurality of LWD sensors to be deployed in and near the bit (e.g., on both the side and bottom faces of the bit). The absence a threaded connection facilitates the routing of various electrical connectors between the sensors in the bit and electrical power sources and electronic controllers located both in and above the bit. The absence of threads also facilitates placement of various sensors and control circuitry at the bit. Moreover, embodiments of the invention do not require tonging surfaces at or near the bit since the bit is an integral part of the system and therefore does not need to be threadably made up to the BHA. This feature further facilitates deployment of various sensors and electronics at and near the bit.

Embodiments of the invention may be advantageously connected, for example, directly to the lower end of a conventional steering tool or mud motor. The invention may also be configured to meet the needs of various directional drilling operations. For example, exemplary embodiments in accordance with the invention may be configured for either point-the-bit or push-the-bit steering (either with or without a near-bit stabilizer).

In one aspect the present invention includes a drilling system. The drilling system includes (i) a drill bit having a drill bit body with a plurality of cutting elements and at least a first logging while drilling sensor deployed therein and (ii) a logging while drilling tool including a logging while drilling tool body having at least a second logging while drilling sensor deployed therein. The drill bit body and the logging while drilling tool body are integral with one another (e.g., of a unitary construction or welded to one another).

In another aspect, the present invention includes a drilling system. The drilling system includes a drill bit having a drill bit body with a plurality of cutting blades formed on a cutting face thereof, each of the cutting blades including a plurality of cutting elements deployed thereon. The drill bit further includes at least one current measuring electrode deployed on one of the cutting blades. A logging while drilling tool includes a logging while drilling tool body having a transmitter deployed thereon. The transmitter is configured to induce an AC voltage difference in the tool body on opposing axial ends of the transmitter. The drill bit body and the logging while drilling tool body are integral with one another.

In still another aspect, the present invention includes a drilling tool. The drilling tool includes an integral tool body having a drill bit body portion integral with a logging while drilling body portion. At least one logging while drilling sensor is deployed in the drill bit body portion.

In yet another aspect the present invention includes a method for fabricating a drilling system. The method includes forming a drilling system tool body having a drill bit body portion and a logging while drilling body portion in which the drill bit body portion is integral with the logging while drilling tool body portion. At least one logging while drilling sensor is deployed on the drill bit body portion and at least one other logging while drilling sensor is deployed on the logging while drilling tool body.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
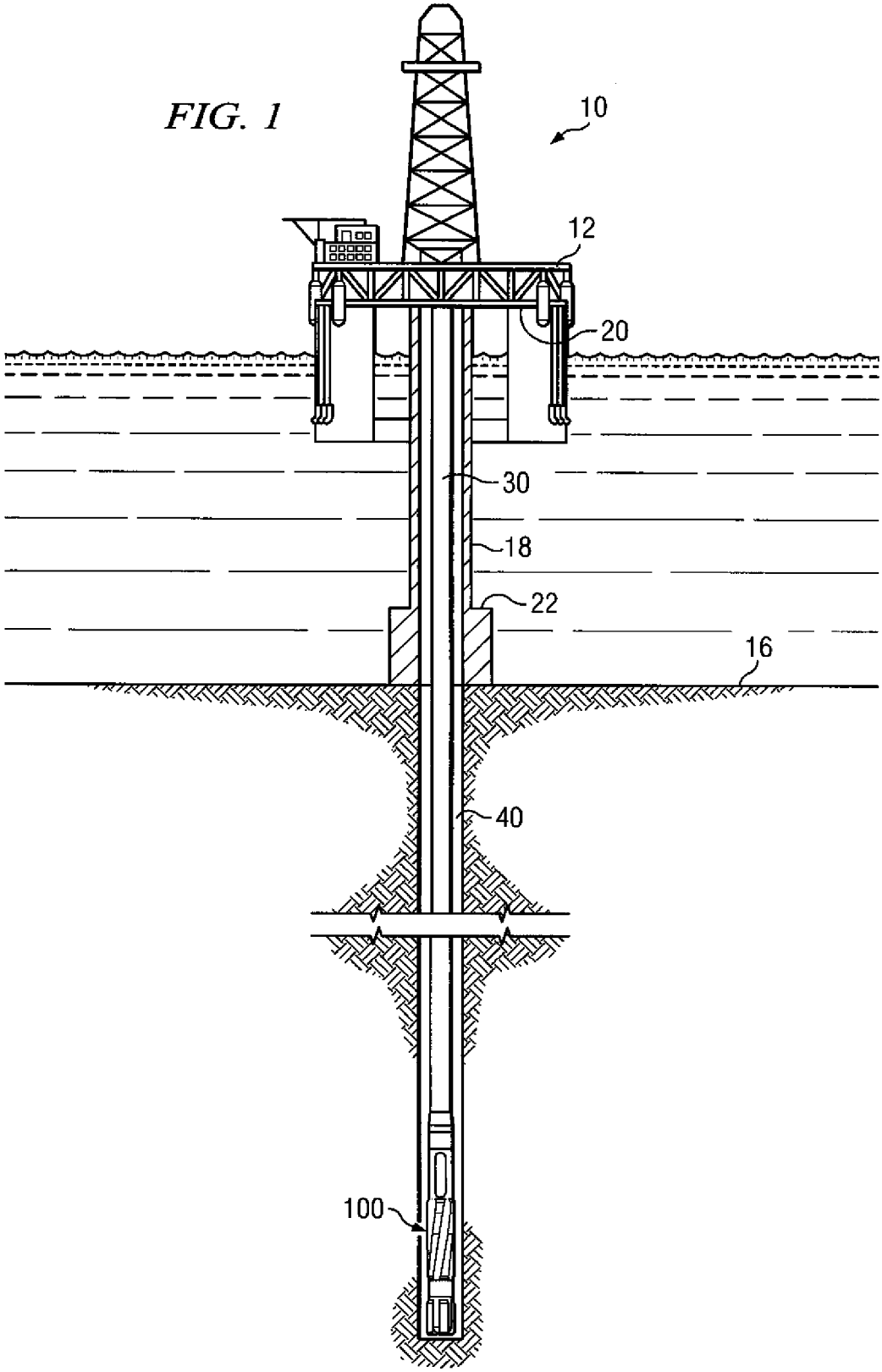
FIG. 1 depicts a conventional drilling rig on which exemplary embodiments of the present invention may be utilized.

Referring now to FIGS. 1 through 13, exemplary embodiments of the present invention are depicted. With respect to FIGS. 1 through 13, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 1 through 13 may be described herein with respect to that reference numeral shown on other views.

FIG. 1 depicts one exemplary embodiment of a drilling system 100 in use in an offshore oil or gas drilling assembly, generally denoted 10. In FIG. 1, a semisubmersible drilling platform 12 is positioned over an oil or gas formation (not shown) disposed below the sea floor 16. A subsea conduit 13 extends from deck 20 of platform 12 to a wellhead installation 22. The platform may include a derrick and a hoisting apparatus for raising and lowering the drill string 30, which, as shown, extends into borehole 40. Drilling system 100 includes a logging while drilling tool having an integral drill bit. As described in more detail below, by integral it is meant that the drilling system includes a one-piece tool body in which there is no threaded connection between the drill bit and the logging while drilling tool. As also described in more detail below, the drilling system 100 may include substantially any number and type of logging sensors known in the drilling arts.

It will be understood by those of ordinary skill in the art that the deployment depicted on FIG. 1 is merely exemplary for purposes of describing the invention set forth herein. It will be further understood that the drilling system 100 of the present invention is not limited to use with a semisubmersible platform 12 as illustrated on FIG. 1. Drilling system 100 is equally well suited for use with any kind of subterranean drilling operation, either offshore or onshore.

Figure 2:
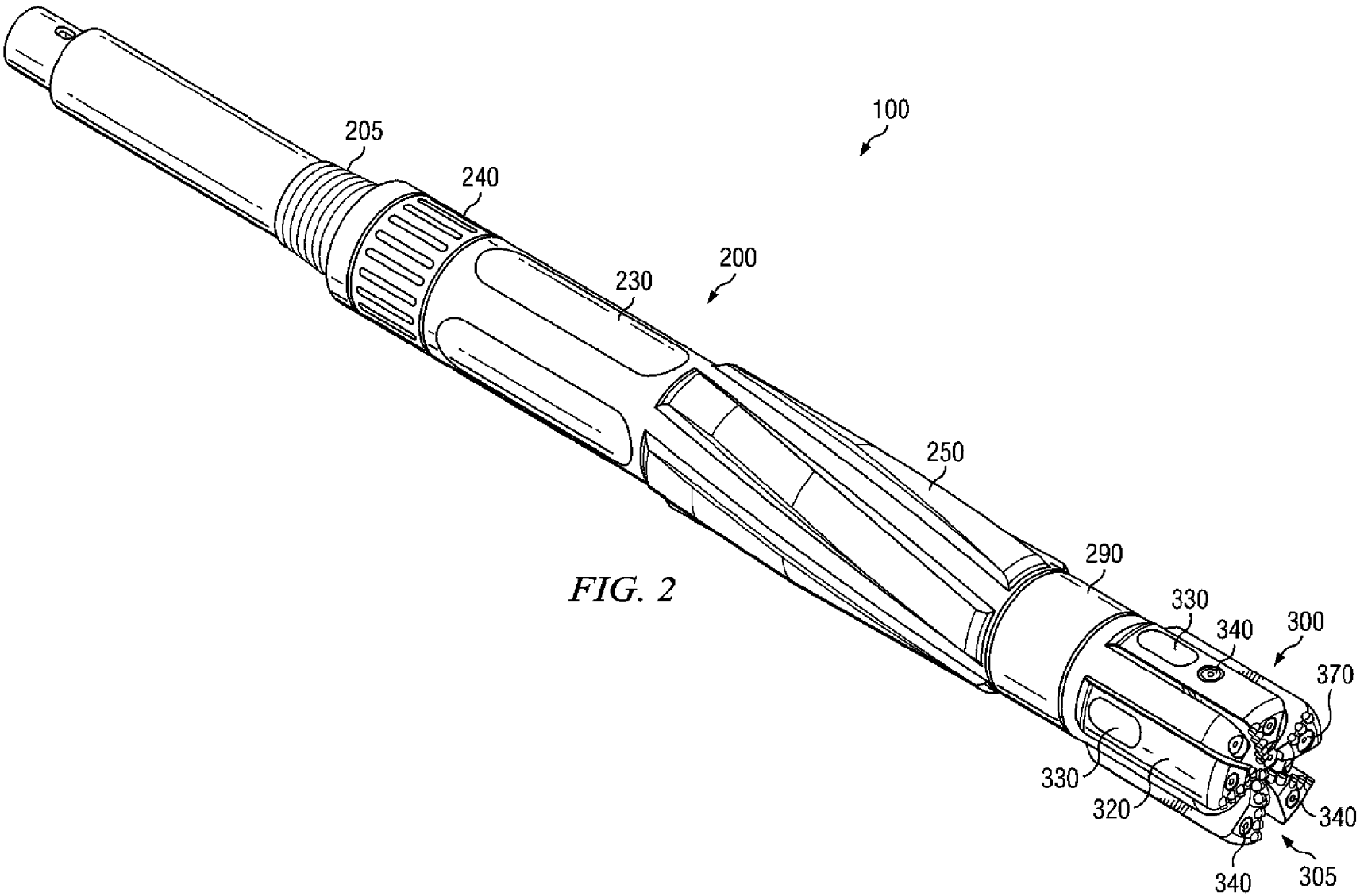
FIG. 2 depicts an isometric view of one exemplary embodiment of a drilling system in accordance with the present invention.

Turning now to FIG. 2, an isometric view of one exemplary embodiment of drilling system 100 is depicted. This exemplary embodiment is described briefly with respect to FIG. 2 and in considerable more detail below with respect to FIGS. 3 through 7. Drilling system 100 includes an integral logging while drilling tool and drill bit. The drilling system 100 may therefore be thought of as including an LWD tool portion 200 integral with a drill bit portion 300. This feature of an integral (one-piece) system is described in more detail below with respect to FIG. 3.

In the exemplary embodiment depicted, drilling system 100 includes a fixed cutter type drill bit 300, which is described in more detail below with respect to FIG. 4. As also depicted, the drill bit portion 300 includes a plurality of resistivity button electrodes 340. These electrodes 340 may be deployed, for example, on the cutting face 305 of the bit for making ahead-of-the-bit resistivity measurements and on at least one of the lateral bit blades 320 for making azimuthal resistivity measurements. The resistivity electrodes 340 are typically configured to measure an alternating current between the formation and the tool body 110. It will be appreciated that other kinds of sensors such as a pressure transducer 370 may also be deployed on the face 305 or lateral side of the bit. A pressure transducer 370 deployed on the cutting face 305 is advantageously disposed to substantially instantaneously detect gas influx into the borehole. However, it will be understood that the invention is not limited in these regards.

With continued reference to FIG. 2, exemplary embodiments of drilling system 100 further include a transmitter 240 configured to induce an AC voltage difference in the tool body on opposing axial ends of the transmitter. This voltage difference induces an alternating electrical current that enters the formation on one side of the transmitter 240 (e.g., above the transmitter) and returns to the tool body 110 on the other side of the transmitter 240 (e.g., below the transmitter). As is known to those of ordinary skill in the art, measurement of this current (e.g., via one or more button electrodes 340) enables a formation resistivity to be determined. Substantially any suitable transmitter configuration may be utilized. For example, transmitter 240 may include one or more conventional wound toroidal core antennae deployed about the tool body 110 such as disclosed in U.S. Pat. No. 5,235,285 to Clark et al. Alternatively, transmitter 240 may include one or more magnetically permeable rings deployed about the tool body 110 such as disclosed in commonly assigned U.S. Pat. No. 7,436,184 to Moore.

In the exemplary embodiment depicted, drilling system 100 may further include a short-hop electromagnetic communication antenna 290 deployed, for example, just above the bit blades 320 for communicating with an uphole tool such as a rotary steerable tool, a conventional LWD tool, and/or a telemetry tool. Such communications may include, for example, data transmission from the drilling system 100 to the uphole tool. It will be understood that the invention is not limited to the use of electromagnetic communications as substantially any other means of communication may be utilized. For example, drilling system 100 may communicate with uphole tools via known sonic or ultrasonic communication techniques. Drilling system 100 may alternatively be electrically connected to an uphole tool, for example, via an electrical connector such as disclosed in commonly assigned U.S. Pat. No. 7,074,064 to Wallace. Such a connector assembly enables hardwired data communication at high data rates as well as electrical power transmission.

As further depicted on FIG. 2, drilling system 100 may further include one or more sealed pockets 330, for example, formed in at least one of the bit blades 320. These pockets may house additional LWD sensors and/or sensor electronics for digitizing and/or processing measurements made by the button electrode(s) 340 and/or other LWD sensors deployed in the bit. Drilling system 100 may further include a plurality of sealed chambers 230 located in LWD tool portion 200. As described in more detail below, these chambers may house still other LWD sensors (e.g., including an azimuthal gamma sensor), sensor electronics, and one or more battery modules. The invention is again not limited in these regards.

With continued reference to FIG. 2, drilling system 100 may include an upper threaded pin end 205, for example, for coupling the drilling system with a rotary steerable shaft or a mud motor. The exemplary embodiment depicted further includes near-bit stabilizer blades 250 and is therefore configured for point-the-bit steering operations. The invention is, of course, not limited to the mere use of a near-bit stabilizer arrangement. Drilling system embodiments in accordance with the invention may also be configured for push-the-bit steering in which there is no near-bit stabilizer. Alternative embodiments in accordance with the invention are described in more detail below with respect to FIGS. 10 through 13. It will also be appreciated that the near-bit stabilizer blades 250 need not be integral with tool body 110 (FIG. 3). Such blades may also be mounted on the tool body 100, for example, via conventional screws or other known means.

Figure 3A:
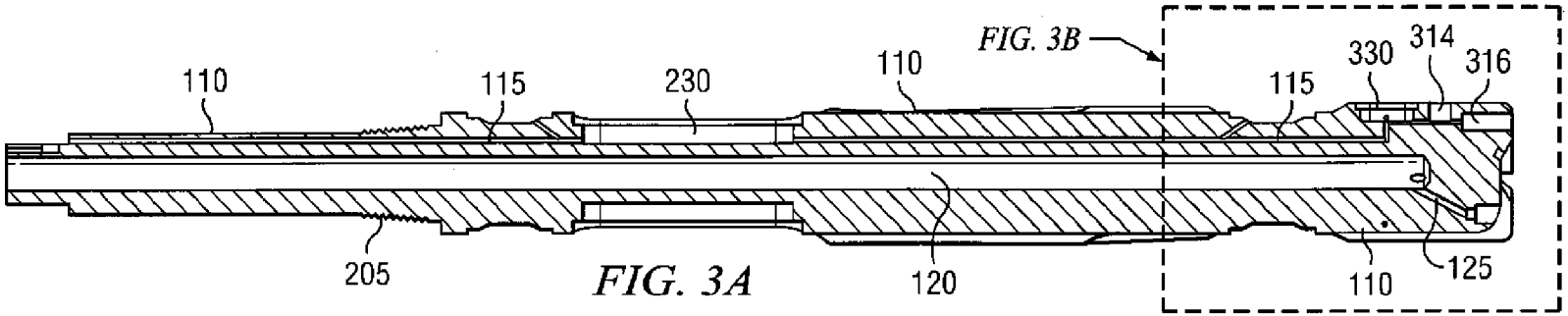
FIGS. 3A and 3B (collectively FIG. 3) depict longitudinal cross sectional views of a tool body portion of the exemplary embodiment depicted on FIG. 2.
Figure 3B:
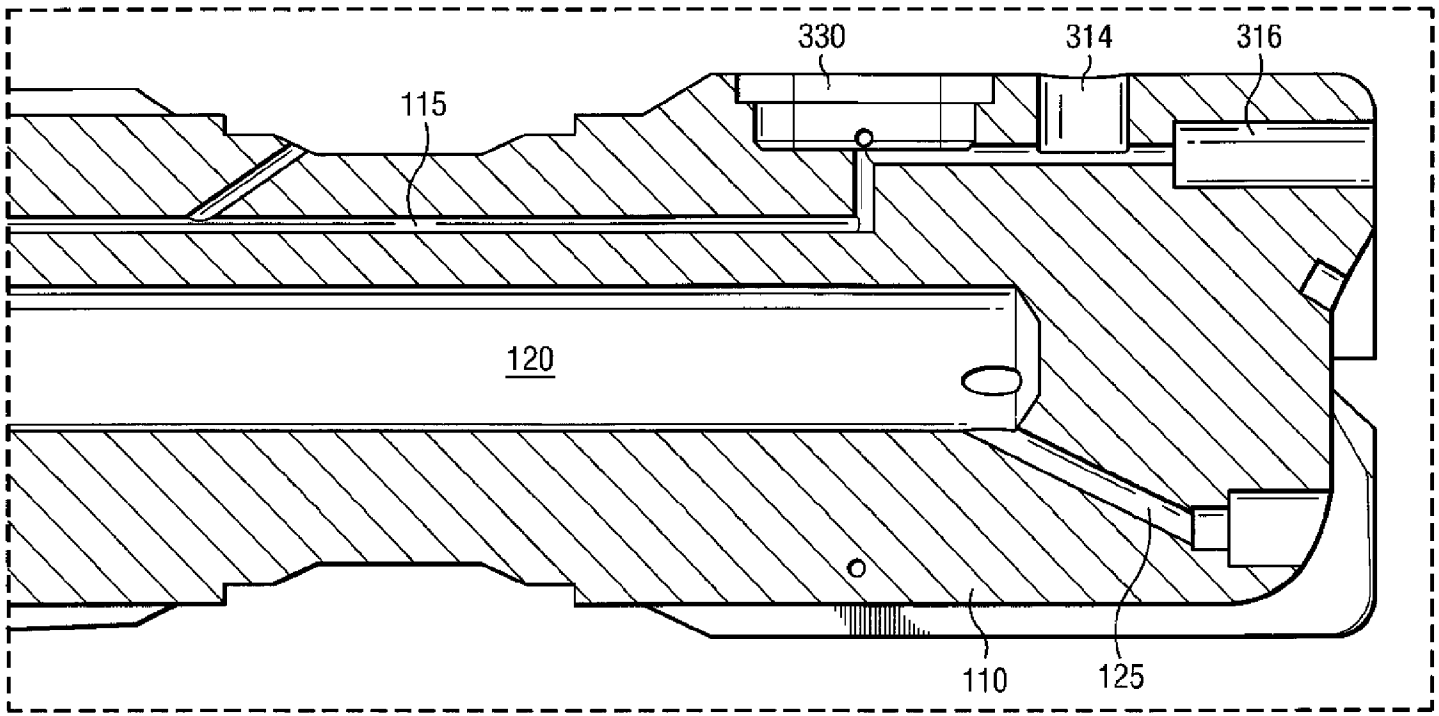

Turning now to FIGS. 3A and 3B (collectively FIG. 3), it will be appreciated that one aspect of the present invention is the realization that the conventional BHA configuration in which a drill bit is threadably connected to the BHA (e.g., to a near bit stabilizer or to a rotary steerable shaft) tends to be poorly suited to the deployment of LWD sensors near the bit or in the bit. One problem with the use of a threaded bit is that the threads occupy critical BHA real-estate just above that bit. Another problem is that the use of a threaded bit makes it difficult to run cables (or other electrical connectors) from the bit to the BHA since the connection is made up by rotating the bit relative to the BHA (e.g., by applying a predetermined torque to the bit).

In FIG. 3 the tool body 110 portion of drilling system 100 is depicted in longitudinal cross section. As noted above, drilling system 100 includes an integral logging while drilling tool portion 200 and drill bit portion 300. By integral it is meant that the drilling system includes a one-piece tool body. As such, it will be understood that the logging while drilling tool portion 200 and the drill bit portion 300 cannot be repeatably connected and disconnected from one another (e.g., via a threaded connection as is conventional in the prior art). In the exemplary embodiment depicted on FIG. 3, the tool body 110 is machined from a single metallic work piece and may therefore be said to be of a unitary construction. As described in more detail below with respect to FIGS. 8 and 9, the drill bit body and the logging while drilling tool body may also be integral in the sense that they are permanently connected to one another (e.g., via an electron beam weld). Again, there are no threads connecting the LWD tool portion 200 and the drill bit portion 300. This absence of threads between the bit and the LWD tool enables a plurality of LWD sensors to be deployed in and near the bit (e.g., on both the side and bottom faces of the bit). The absence of threads also facilitates the routing of various electrical connectors between the sensors in the bit and electrical power sources and electronic assemblies located above the bit. Moreover, drilling system 100 advantageously requires no tonging surfaces at or near the bit since the bit is an integral part of the system. This feature further facilitates deployment of various sensors and electronics at and near the bit.

With continued reference to FIG. 3, tool body 110 includes at least one longitudinal bore 115 for routing the above mentioned electrical connectors. This bore 115 provides for electrical and/or electronic communication between the various power sources, electronic controllers, and sensors deployed in the tool 100. For example only, a power source located in chamber 230 may be electrically connected with an antenna mounted in antenna groove 215, an electronic controller deployed in one of pockets 330, and button electrodes deployed in bit cavities 314 and 316. It will be appreciated that bore 115 may be formed, for example, using conventional gun drilling techniques. The absence of threads between the bit portion 300 and the LWD tool portion 200 advantageously ensures that the bore 115 is substantially unobstructed along its full length.

Figure 4:
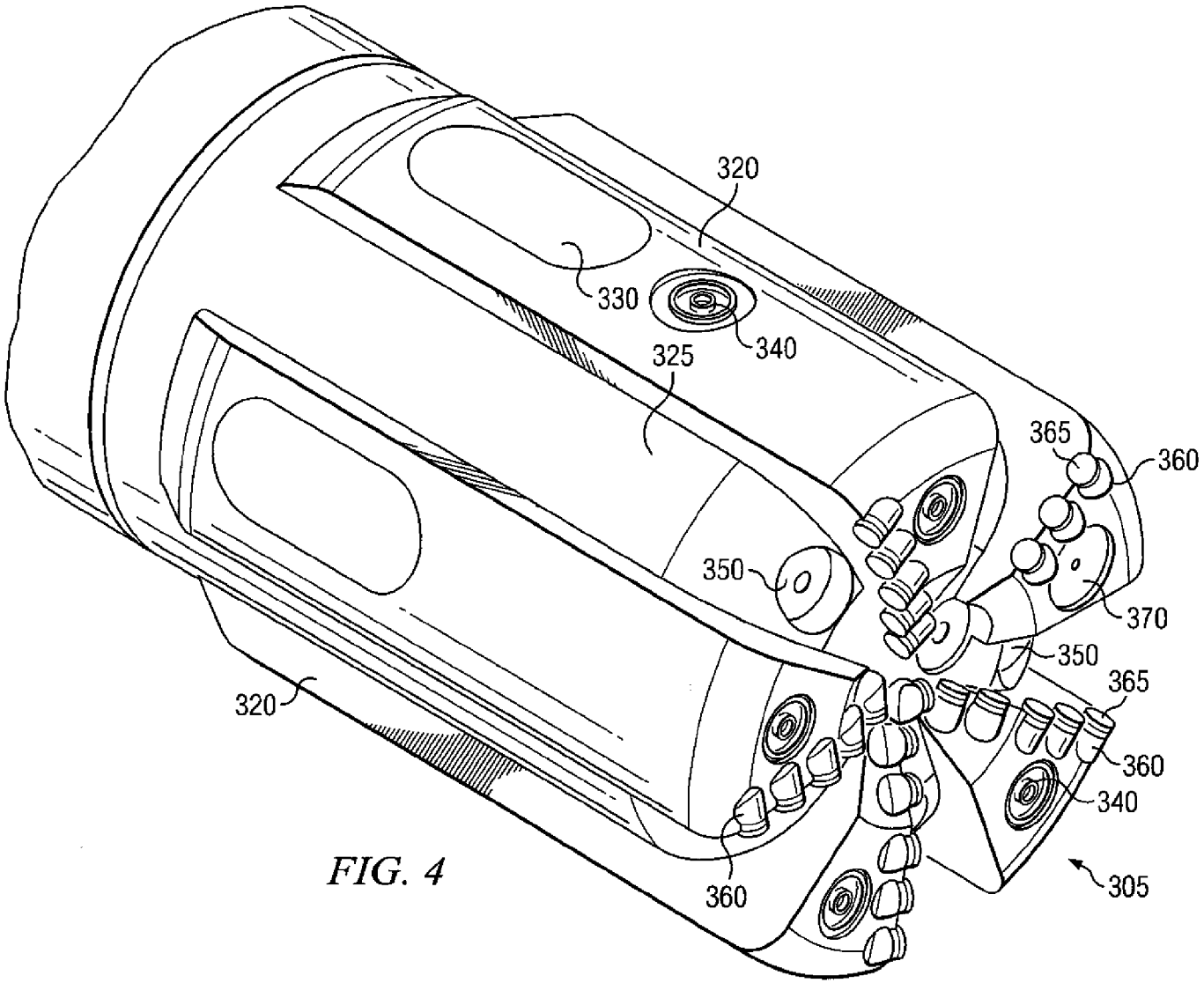
FIG. 4 depicts an isometric view of a drill bit portion of the exemplary embodiment depicted on FIG. 2.

Turning now to FIG. 4, drilling system 100 includes an integral drill bit portion 300 (as described above). In the exemplary embodiment depicted the drill bit portion 300 includes a fixed cutter bit. While the invention is not limited in this regard and may also utilize a roller cone bit configuration, fixed cutter bits are generally preferred. As is known to those of ordinary skill in the art, fixed cutter bits commonly include extremely hard cutting elements 360 (e.g., including at least one polycrystalline diamond layer 365) deployed on each of a plurality of cutting blades 320. The exemplary embodiment depicted includes five primary cutting blades 320. The invention is, of course, not limited in these regards and may include substantially any suitable number of primary blades. Those of ordinary skill in the art will readily appreciate that fixed cutter bits commonly also include secondary blades, and sometimes even tertiary blades, angularly spaced about the bit face. Exemplary embodiments of drilling system 100 may likewise include secondary and tertiary cutting blades if so desired. The invention is not limited to any particular cutting blade configuration.

Those of ordinary skill in the art will also appreciate that the layout of the cutting elements 360 on the blades 320 may vary widely depending upon a number of factors including the formation properties (as different cutter element layouts engage and cut the various strata in a formation with differing results and effectiveness). As stated above, the cutter elements 360 commonly include a layer of polycrystalline diamond 365. Fixed cutter bits are therefore usually referred to in the art as polycrystalline diamond cutter (PDC) bits. However, those of ordinary skill in the art will appreciate that the cutter elements may alternatively and/or additionally employ other super abrasive materials, e.g., including cubic boron nitride, thermally stable diamond, polycrystalline cubic boron nitride, or ultra-hard tungsten carbide. The invention is not limited in these regards.

Drilling system 100 further includes one or more drill bit jets 350 (also referred to in the art as nozzles or ports) spaced about the cutting face 305 for injecting drilling fluid into the flow passageways 325 between the blades 320. These jets are connected to through bore 120 via corresponding ports 125 in the tool body 110 (FIGS. 3 and 6). As is known to those of ordinary skill in the art, the drilling fluid serves several purposes, including cooling and lubricating the drill bit, clearing cuttings away from the bit and transporting them to the surface, and stabilizing and sealing the formation(s) through which the borehole traverses. Those of ordinary skill in the art will readily appreciate that the number and placement of drilling fluid jets can be important criteria in bit performance. Notwithstanding, the invention is not limited in these regards as substantially any jet configuration may be employed. As also depicted, the primary cutting blades generally project radially outward along the bit body and form flow channels 325 there between for the upward flow of drilling fluid to the surface.

With continued reference to FIG. 4, and further reference now to FIGS. 5-7, drill bit portion 300 preferably includes a plurality of LWD sensors (e.g., button electrodes 340) deployed therein. The exemplary embodiment depicted includes a plurality of button electrodes 340 deployed in corresponding cavities 316 formed in the cutting face 305 of the tool 100. While the electrodes 340 are preferably deployed on the cutting blades 320 (in near contact with the formation), they may alternatively and/or additionally be deployed between the blades in channel 325. Being deployed on the cutting face 305 of the bit, these electrodes 340 are sensitive to formation resistivity ahead of the bit. Placement of the electrodes 340 at the bit face 305 also provides for measurements to be made as the formation is being cut prior to drilling fluid invasion. While the invention is not limited in this regard, the use of a plurality of electrodes 340 (e.g., four in the exemplary embodiment depicted) advantageously provides for noise reduction (e.g., via signal averaging) and redundancy in the event of electrode failure in service.

The exemplary embodiment depicted further includes at least one button electrode 340 deployed in a corresponding cavity 314 on a lateral face of at least one of the bit blades 320 (preferred embodiments include at least one electrode deployed on each of at least two blades). Such electrodes are configured for making azimuthally resolved resistivity measurements at the bit as the drilling system 100 rotates in the borehole. As described in more detail below, these measurements may be advantageously utilized to acquire resistivity images while drilling.

Exemplary embodiments of drilling system 100 may also include two or more electrodes 340 deployed at substantially the same azimuthal position (i.e., at the same tool face) but longitudinally offset from one another. This may be accomplished, for example, via deploying a first electrode on a lateral face of blade 320 as depicted at 340 and a second axially spaced electrode (not shown) on one of the near-bit stabilizer blades 250. In such an embodiment, the electrode(s) that is located farther from the antenna 240 (in the bit blade) is expected to provide deeper reading resistivity measurements than the electrode(s) that is located nearer to the antenna (e.g., in the near-bit stabilizer blade). Again, as stated above, this invention is not limited to any particular button electrode spacing.

With continued reference to FIGS. 4 through 7, button electrodes 340 are configured so as to provide a segregated path for electrical current flow (typically AC current) between the formation and the tool body 110. As is known to those of ordinary skill in the art, the formation resistivity in a region of the formation generally opposing the electrode may be determined via measurement of the AC current in the electrode. The apparent formation resistivity is inversely proportional to the current measured at the electrode 230. Assuming that the tool body is an equi-potential surface, the apparent formation resistivity may be approximated mathematically, for example, by the equation: $R_f=V/I$, where V represents the voltage between upper and lower portions of the tool body and I represents the measured current. It will be appreciated that various corrections may be applied to the apparent formation resistivity to compensate, for example, for borehole resistivity, electromagnetic skin effect, and geometric factors that are known to influence the measured current.

While not depicted in such detail in the accompanying FIGURES, button electrodes 340 may be mounted in an insulating material such as a Viton® rubber (DuPont® de Nemours, Wilmington, Del.) so as to electrically isolate an outer face of the electrode from the tool body 110. A neck portion of the electrode 340 may be connected to the tool body 110 such that electrical current flows through the electrode (e.g., from the tool body through the electrode to the formation). The electrode 340 may further include a conventional current measuring transformer (e.g., deployed about the neck) for measuring the AC current in the electrode 340. Such an arrangement is know to function as a very low impedance ammeter. Of course, other suitable arrangements may also be utilized to measure the current in the electrode 340. For example, a current sampling resistor (preferably having a resistance significantly less than the sum of the formation and borehole resistances) may be utilized in conjunction with a conventional voltmeter. Alternatively, a Hall-Effect device or other similar non-contact measurement may be utilized to infer the current flowing in the electrode via measurement of a magnetic field. In still another alternative embodiment, a conventional operational amplifier and a feedback resistor may be utilized. Such current measuring devices may be deployed on a circuit board 345 deployed with the electrode in cavity 316. It will be appreciated that this invention is not limited by any particular technique utilized to measure the electrical current in the electrode(s).

Drilling system 100 advantageously further includes electronic circuitry, for example, for controlling electrodes 340 and other sensors (e.g., pressure transducer 370) deployed at or near the bit. This circuitry may be deployed, for example, in pockets 330 as depicted at 332 and typically includes a microprocessor and other electronics suitable for digitizes and preprocessing the various sensor measurements. In such an embodiment, the microprocessor output (rather than the signals from the individual sensors) may be transmitted to a main controller deployed further away from the sensors (e.g., in one of chambers 230). This configuration advantageously reduces wiring requirements in the body of the tool and also tends to advantageously reduce electrical interference.

Figure 5A:
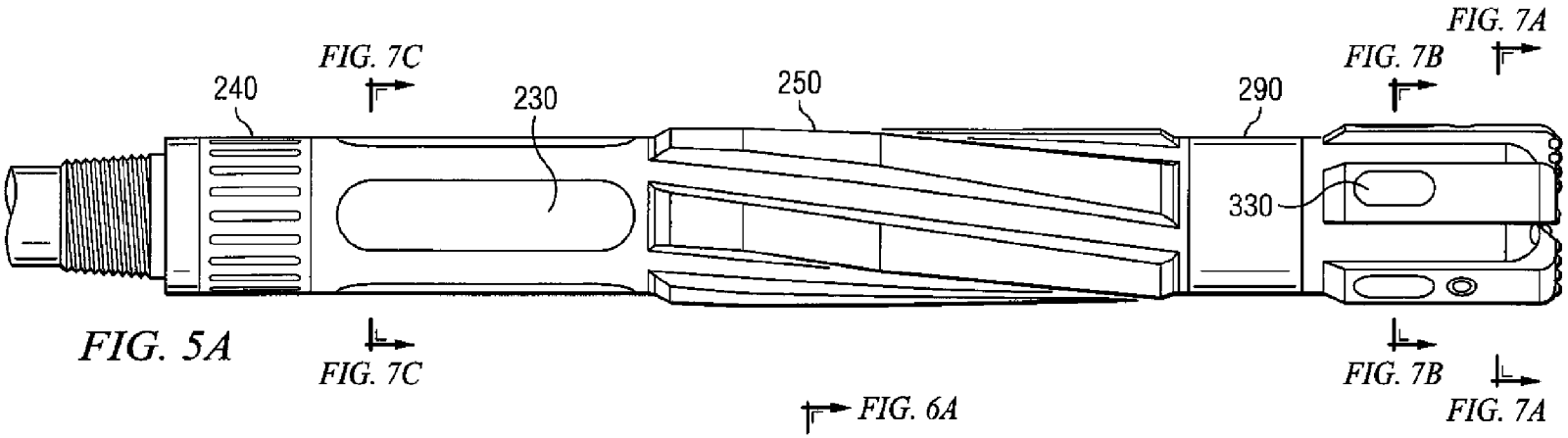
FIGS. 5A and 5B (collectively FIG. 5) depict side and bottom views of the exemplary embodiment shown on FIG. 2.
Figure 5B:
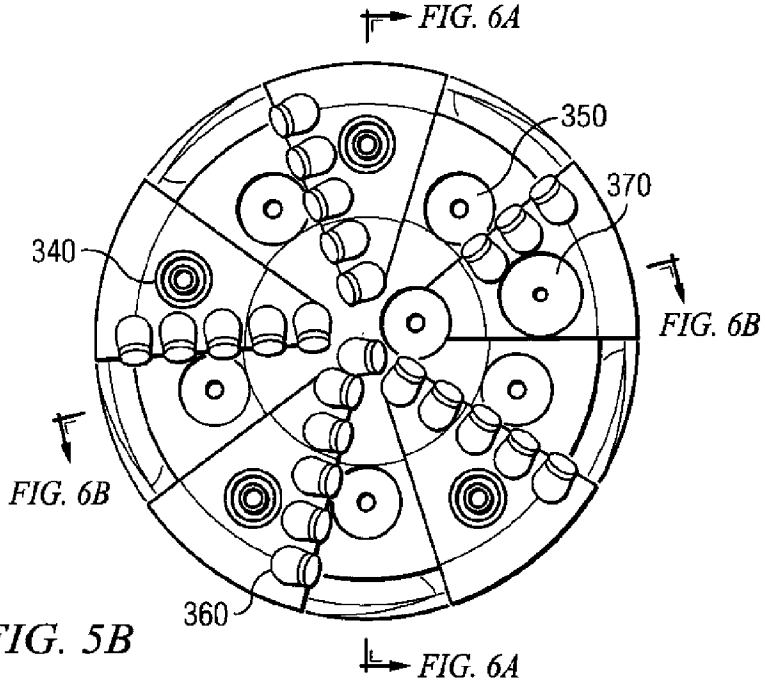
Figure 6A:
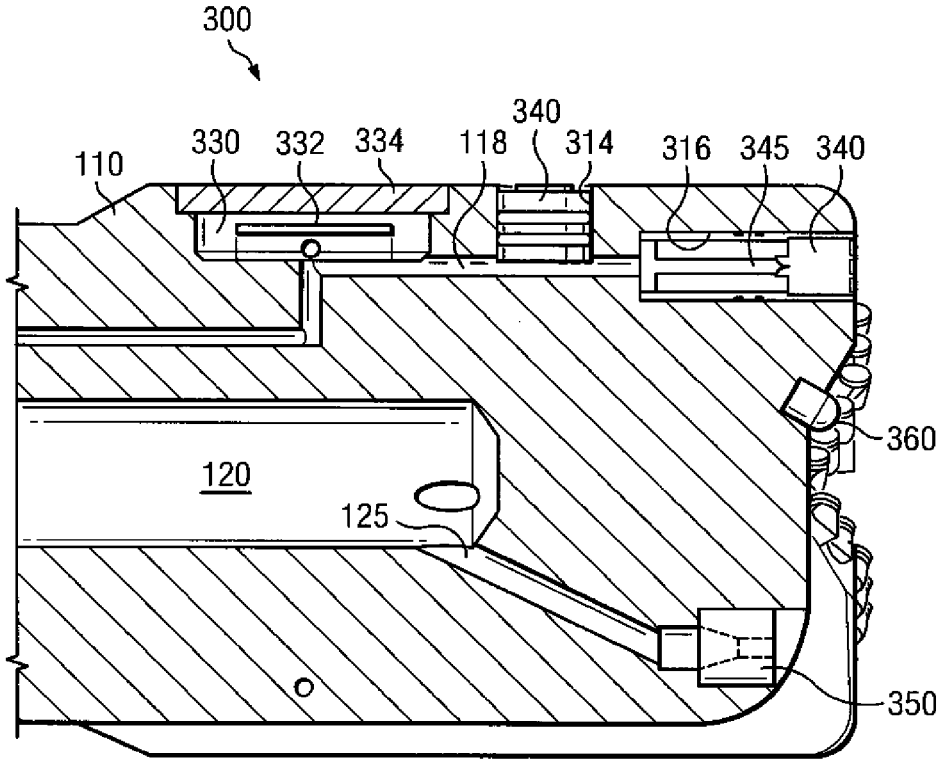
FIGS. 6A and 6B (collectively FIG. 6) depict longitudinal cross sectional views as shown on FIG. 5B.
Figure 6B:
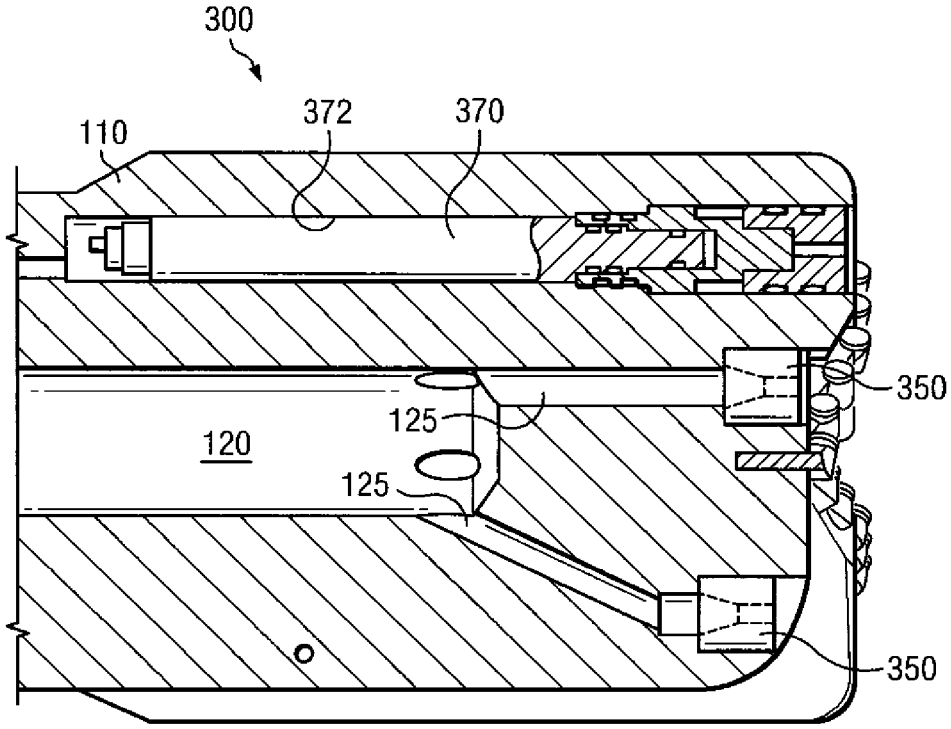

FIG. 5A depicts a side view of the drilling system 100 shown on FIG. 2 while FIG. 5B depicts a view of the cutting face 305 (a bottom view). FIG. 6A depicts a cross sectional view through two of the button electrodes 340 and one of the drill bit jets 350 as shown on FIG. 5B. As also depicted, an axial bore 118 is provided for electrical and/or electronic communication with electronic circuitry 332 as well as with LWD tool portion 200 via bore 115. FIG. 6B depicts a cross sectional view through the pressure transducer 370 and two of the drill bit jets 350 as shown on FIG. 5B. As depicted, pressure transducer 370 is deployed in an enlarged cavity 372 (enlarged as compared to cavities 316) in bit face 305. In the exemplary embodiment depicted, pressure transducer 370 is configured to provide a digital output which may be communicated, for example, to LWD tool portion 200 via bore 115 (although the invention is not limited in these regards).

Figure 7A:
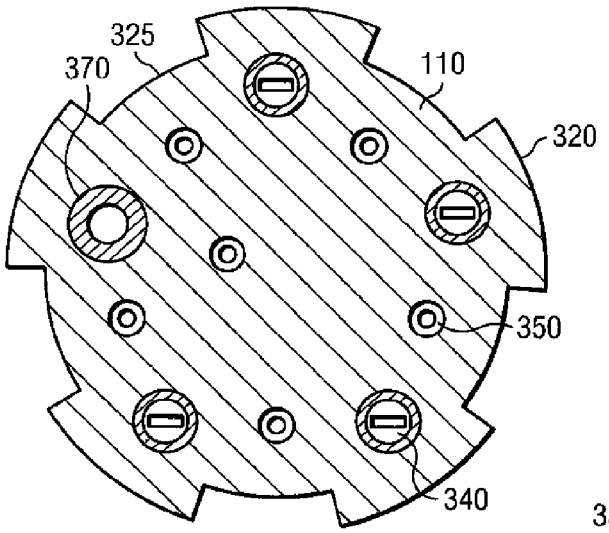
FIGS. 7A, 7B, and 7C (collectively FIG. 7) depict circular cross sectional views as shown on FIG. 5A.
Figure 7B:
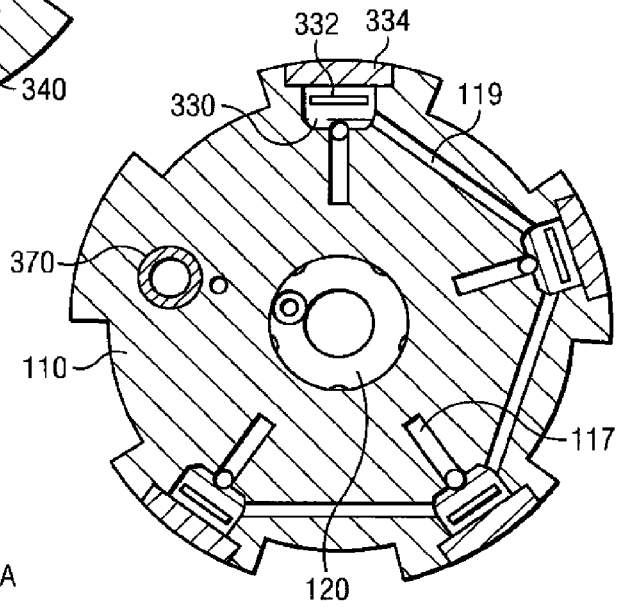
Figure 7C:
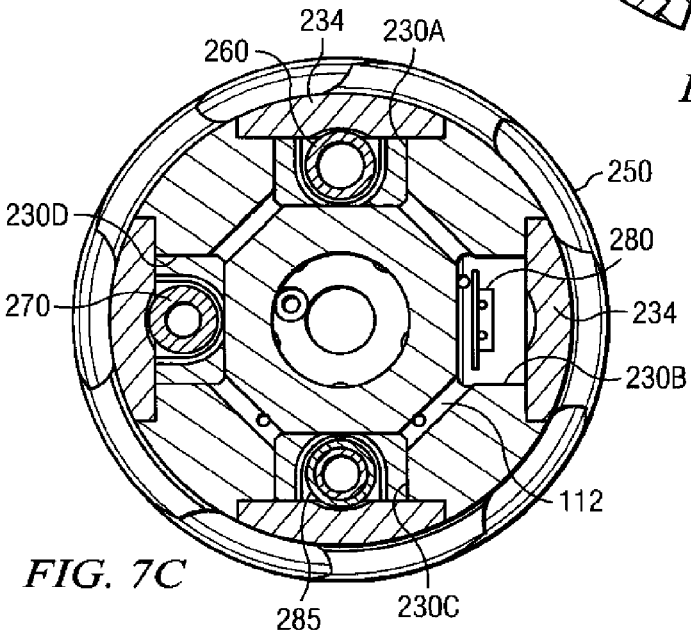

FIGS. 7A, 7B, and 7C depict circular cross sectional views at distinct axial positions along the length of drilling system 100 as shown on FIG. 5A. FIG. 7A depicts LWD sensors (button electrodes 340 and pressure transducer 370) and drill bit jets 350 distributed in alternating fashion about the circumference of the tool 100. In the exemplary embodiment depicted one additional jet 350 is deployed near the centerline of the tool. As described above with respect to FIG. 4, electrodes 340 are preferably deployed on bit blades 320 while the jets 350 are preferably deployed in the passageways 325 between the blades 320 (although the invention is not limited in this regard).

FIG. 7B depicts sealed pockets 330 formed in bit blades 320. Each of the pockets preferably includes a cover 334 that is configured to sealingly engage tool body 110. The cover 334 may be readily removed at the surface thereby providing access to the sensor(s) and/or electronic components deployed in the pocket 330. In the exemplary embodiment depicted, each of the pockets 330 includes an electronic circuit board for controlling the various sensors deployed in the bit. The electronics may also be configured to preprocess sensor data. Such preprocessing may include, for example, digitizing, averaging data from multiple sensors, and filtering. The invention is not limited in these regard as one or more of the pockets 330 may alternatively and/or additionally house additional LWD sensors. Oblique bores 119 provide for electrical connections between the pockets 330. These connections provide for communication and synchronization of the various sensor electronics deployed in the bit. Synchronization can be important, for example, in LWD imaging operations. Radial bores 117 provide for communication with bore 115 and the LWD portion 200 of the drilling system 100.

FIG. 7C depicts sealed chambers 230A, 230B, 230C, and 230D (collectively 230) formed in tool body 110. Each of the chambers preferably includes a cover 234 that is configured to sealingly engage the tool body 110. The cover 234 may be readily removed at the surface thereby providing access to the sensor(s) and/or electronic components deployed in the chamber 230. In the exemplary embodiment depicted chamber 230A includes a battery deployment 260 for providing electrical power to the drilling system 100 (e.g., to the various sensors and electronics deployed in the tool). The invention is, of course, not limited in this regard as electrical power may alternatively be received from an uphole generator or battery sub (e.g., via a hardwired connection to such an uphole sub). The exemplary embodiment depicted further includes a central controller 280 deployed in chamber 230B, directional sensors 285, e.g., including tri-axial accelerometers and tri-axial magnetometers deployed in chamber 230C, and an azimuthal gamma detector 270 deployed in chamber 230D. Oblique bores 112 provide for electrical connections between the chambers 230 which facilitates electronic communication and power transfer.

It will be understood that the invention is not limited to any particular LWD sensor or electronic controller configuration. Other embodiments in accordance with the present invention may include various other LWD sensor deployments. For example, the drilling system may include first and second axially spaced antenna configured for making directional resistivity measurements. Such antenna may include, for example, conventional z-mode, x-mode, or collocated z-mode and x-mode antennae. Directional resistivity measurements are commonly utilized to locate bed boundaries not intercepted by the bit and are known to be useful in geosteering applications. Other sensor deployments may include, for example, a gamma ray sensor, a spectral density sensor, a neutron density sensor, a micro-resistivity sensor, an acoustic velocity sensor, and acoustic and physical caliper sensors.

With continued reference to FIG. 6D, a suitable controller 280 typically includes one or more microprocessors and processor-readable or computer-readable program code for controlling the function of the drilling system. A suitable controller may include instructions, for example, for processing various LWD sensor measurements. Such instructions are conventional in the prior art. A suitable controller 280 may also be configured to construct LWD images of the subterranean formation based on directional formation evaluation measurements (e.g., azimuthal resistivity measurements acquired from electrodes 340 and azimuthal gamma measurements acquired from sensor 270). In such imaging applications, the formation evaluation measurements may be acquired and correlated with corresponding azimuth (toolface) measurements (obtained, for example, from the directional sensors 285 deployed in chamber 240C) while the tool rotates in the borehole. As such, the controller 280 may therefore include instructions for temporally correlating LWD sensor measurements with sensor azimuth (toolface) measurements. The LWD sensor measurements may further be correlated with depth measurements. Borehole images may be constructed using substantially any know methodologies, for example, including conventional binning, windowing, or probability distribution algorithms. U.S. Pat. No. 5,473,158 discloses a conventional binning algorithm for constructing a borehole image. Commonly assigned U.S. Pat. No. 7,027,926 to Haugland discloses a technique for constructing a borehole image in which sensor data is convolved with a one-dimensional window function. Commonly assigned U.S. Pat. No.

7,558,675 to Sugiura discloses an image constructing technique in which sensor data is probabilistically distributed in either one or two dimensions.

A suitable controller 280 may also optionally include other controllable components, such as other sensors, data storage devices, power supplies, timers, and the like. As described above, the controller 280 is disposed to be in electronic communication with the various sensors deployed in the drilling system. The controller 280 may also optionally be disposed to communicate with other instruments in the drill string, such as telemetry systems that further communicate with the surface or a steering tool. Such communication can significantly enhance directional control while drilling. A controller may further optionally include volatile or non-volatile memory or a data storage device for downhole storage of sensor measurements and LWD images. The invention is not limited in these regards.

Figure 8:
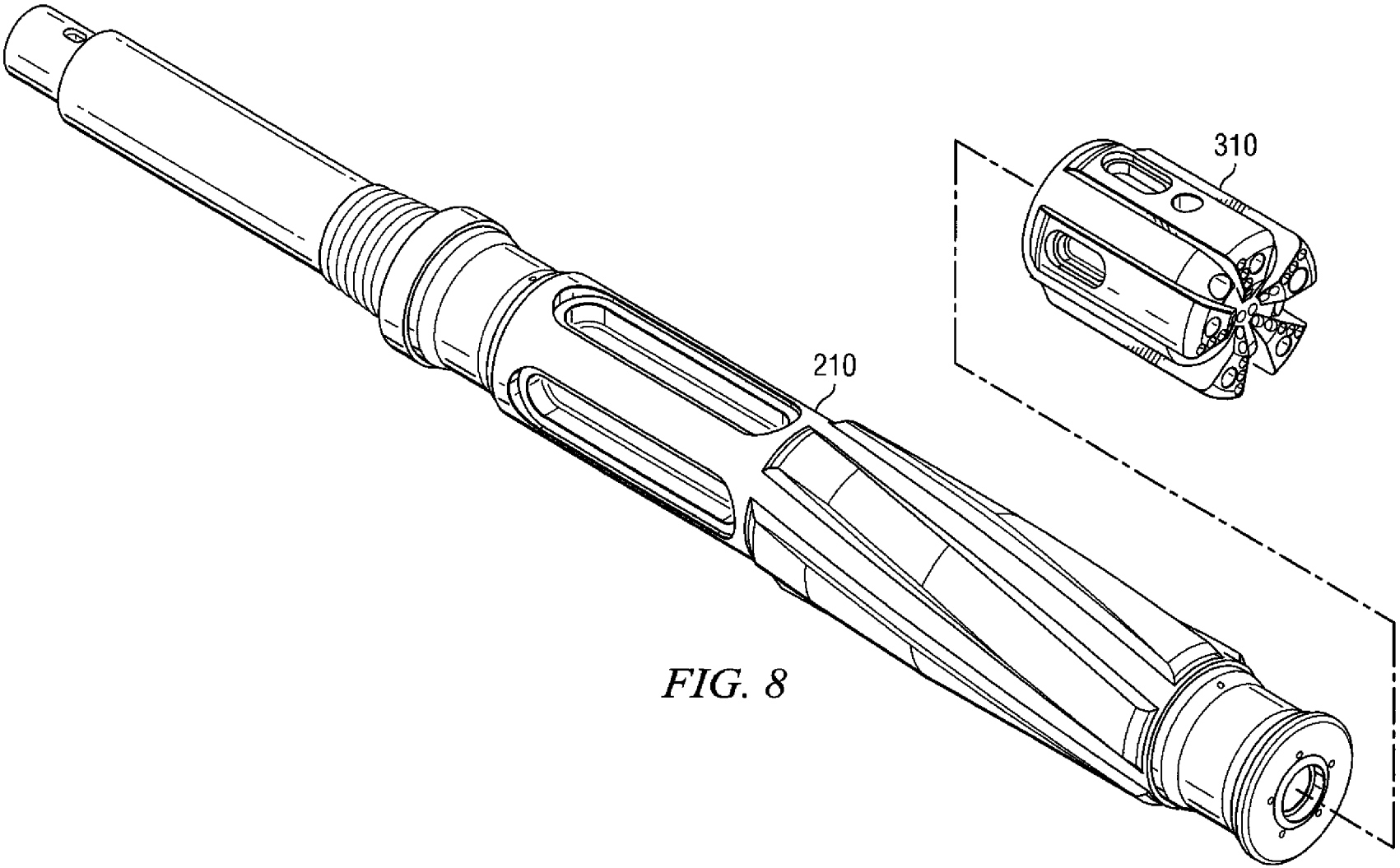
FIG. 8 depicts an exploded view of the tool body portion of an alternative embodiment in accordance with the present invention.
Figure 9A:
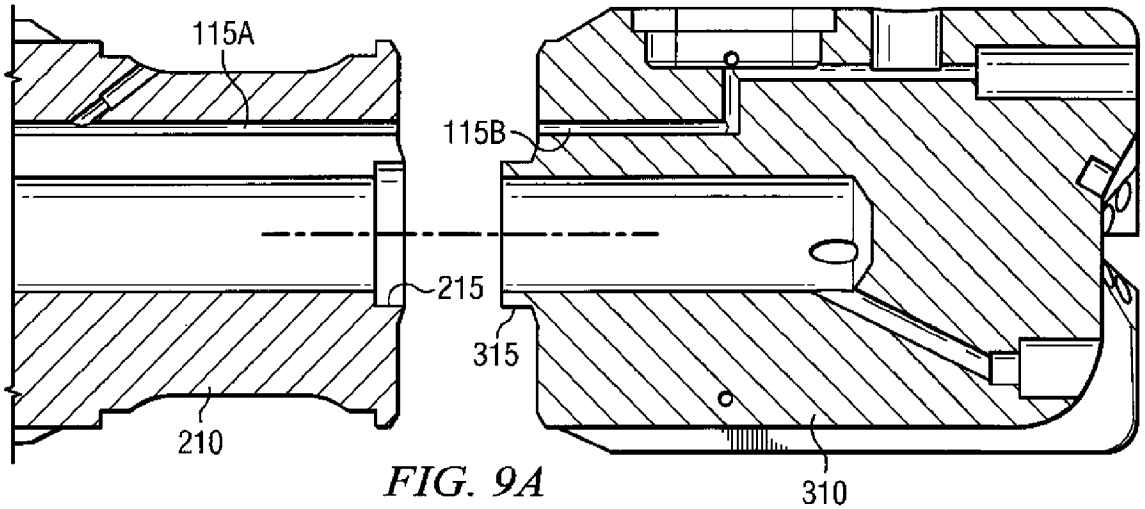
FIGS. 9A and 9B (collectively FIG. 9) depict longitudinal cross sectional views of a portion of the tool body depicted on FIG. 8.
Figure 9B:
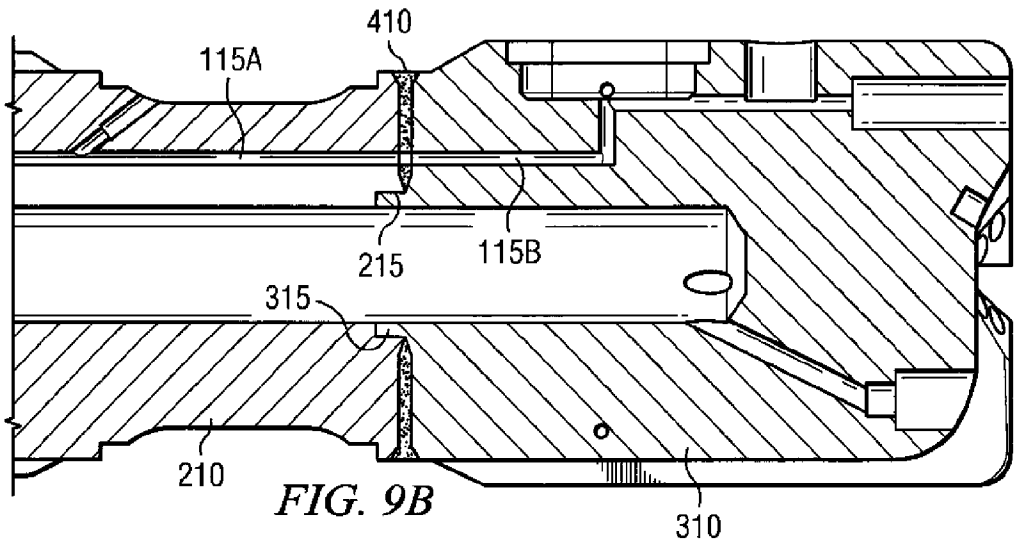

Turning now to FIGS. 8 and 9, it will be appreciated that the invention is not limited to embodiments in which the tool body is machined from a single work piece. In FIGS. 8 and 9, a logging while drilling tool body 210 and a drill bit body 310 are machined from first and second distinct work pieces. In the exemplary embodiment depicted, drill bit body 310 includes a cylindrical key 315 sized and shaped for insertion into an enlarged bore 215 in LWD body 210. Upon completion of at least some of the machining, the body portions 210 and 310 may be connected via inserting key 315 into bore 215 and rotating one with respect to the other so as to align bore 115A and 115B. The body portions 210 and 310 may then be welded to one another (as depicted at 410), for example, using conventional electron beam welding techniques. After the welding operation is completed, bore 115 may be further machined, for example, to remove weld filler material therefrom. It will be appreciated that with the exception of the above described welded connection, the exemplary tool body 110' depicted on FIG. 9B is essentially identical to tool body 110 depicted on FIG. 3. Both embodiments may be said to include an integral (one-piece) tool body in which there are no threads connecting the LWD tool portion to the drill bit portion. The various sensors and electronic components described above with respect to FIGS. 2 through 6 may preferably deployed on the tool body 110' after the welding operation is completed.

Figure 10:
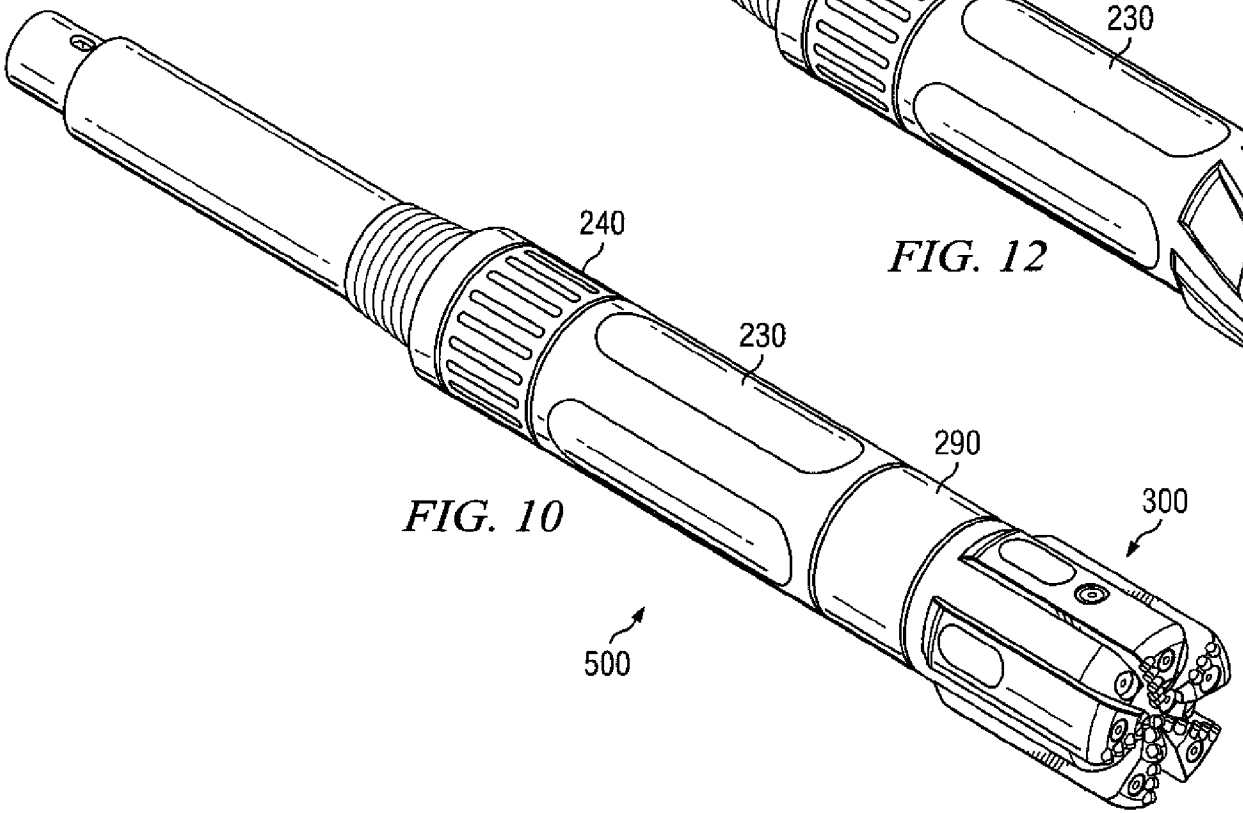
FIG. 10 depicts an isometric view of one alternative embodiment of a drilling system in accordance with the present invention.

Those of ordinary skill in the art will readily appreciate that there are numerous lower BHA configurations that are commonly used in directional drilling operations. For example, as described above with respect to FIG. 2, both point-the-bit and push-the bit configurations are commonly utilized. FIG. 10 depicts one alternative embodiment of a drilling system 500 in accordance with the present invention configured for push-the-bit steering. As such, this embodiment does not include near-bit stabilizer blades 250 (FIG. 2). Removal of the near-bit stabilizer results in a shorter tool and a drilling system that tends to be better suited for drilling high dogleg severity boreholes. Drilling system 500 is otherwise substantially identical to drilling system 100 depicted on FIG. 2.

Figure 11:
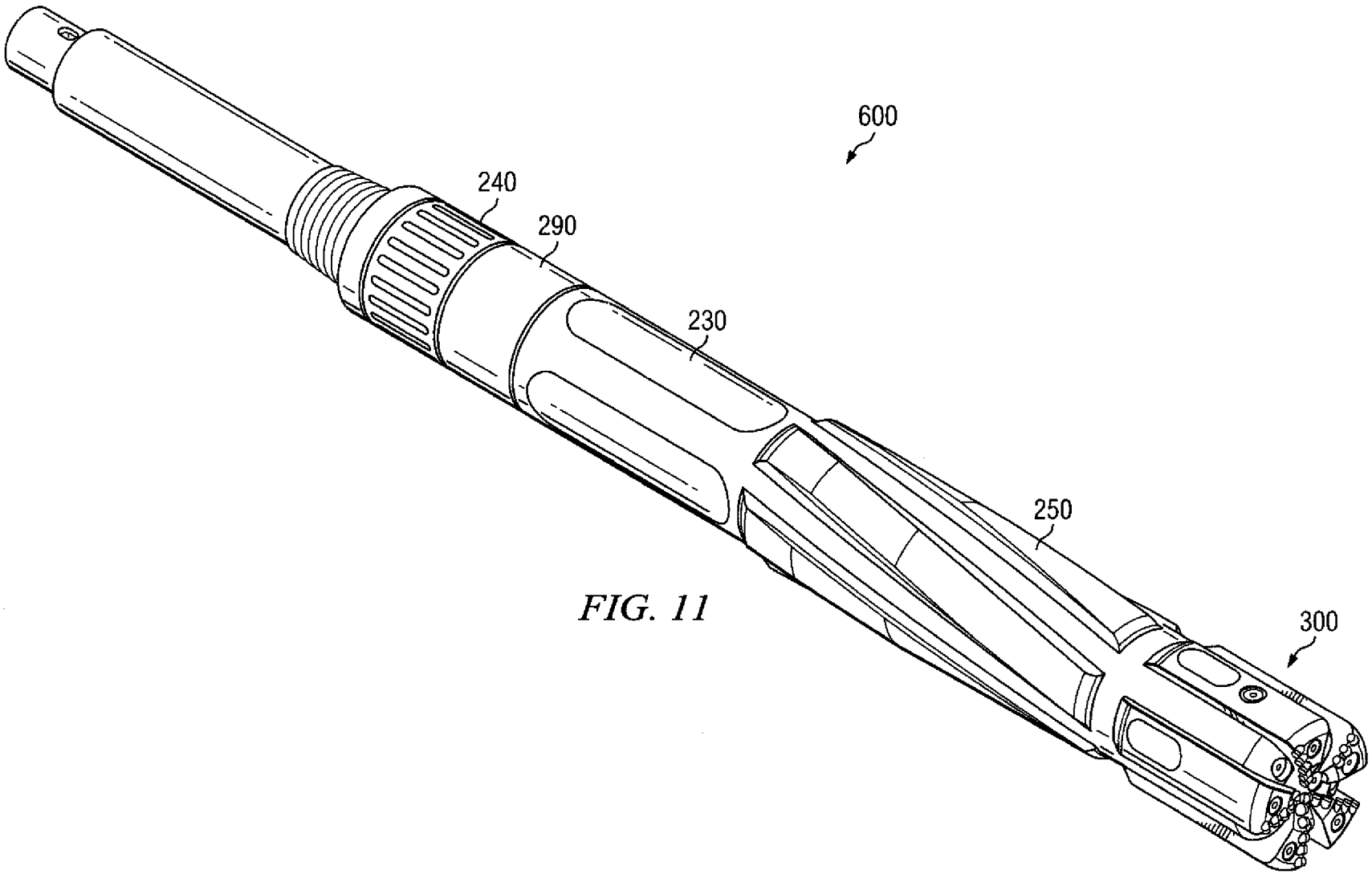
FIG. 11 depicts an isometric view of another alternative embodiment of a drilling system in accordance with the present invention.

FIG. 11 depicts an alternative embodiment in accordance with the present invention configured for point-the-bit steering. Drilling system 600 is substantially identical to drilling system 100 with the exception that the near-bit stabilizer blades 250 are deployed just above drill bit portion 300. In this embodiment, the short-hop communication antenna 290 is deployed further up the tool between chambers 230 and antenna 240. Deployment of the near-bit stabilizer blades just above the bit may enhance directional control in certain drilling operations.

Figure 12:
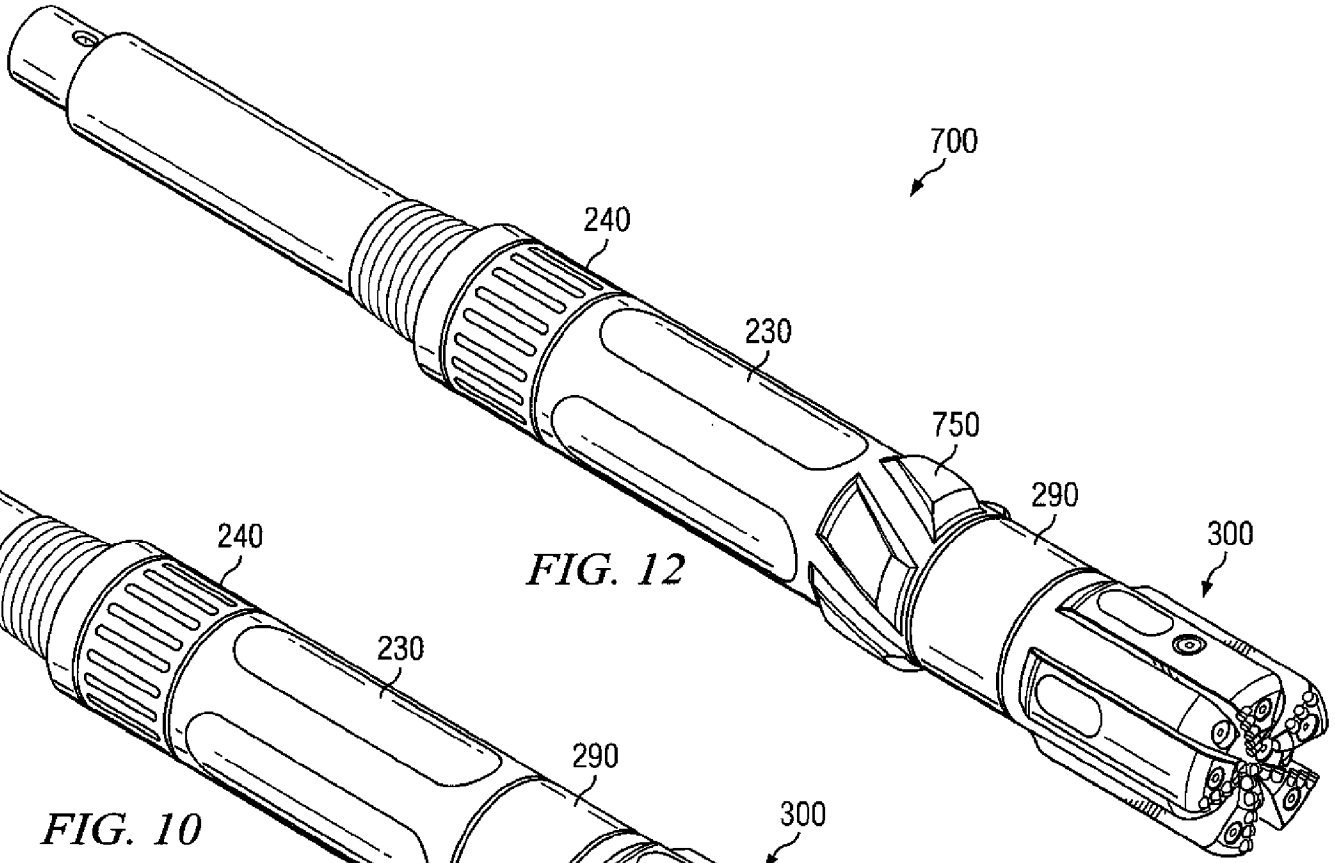
FIG. 12 depicts an isometric view of yet another alternative embodiment of a drilling system in accordance with the present invention.
Figure 13:
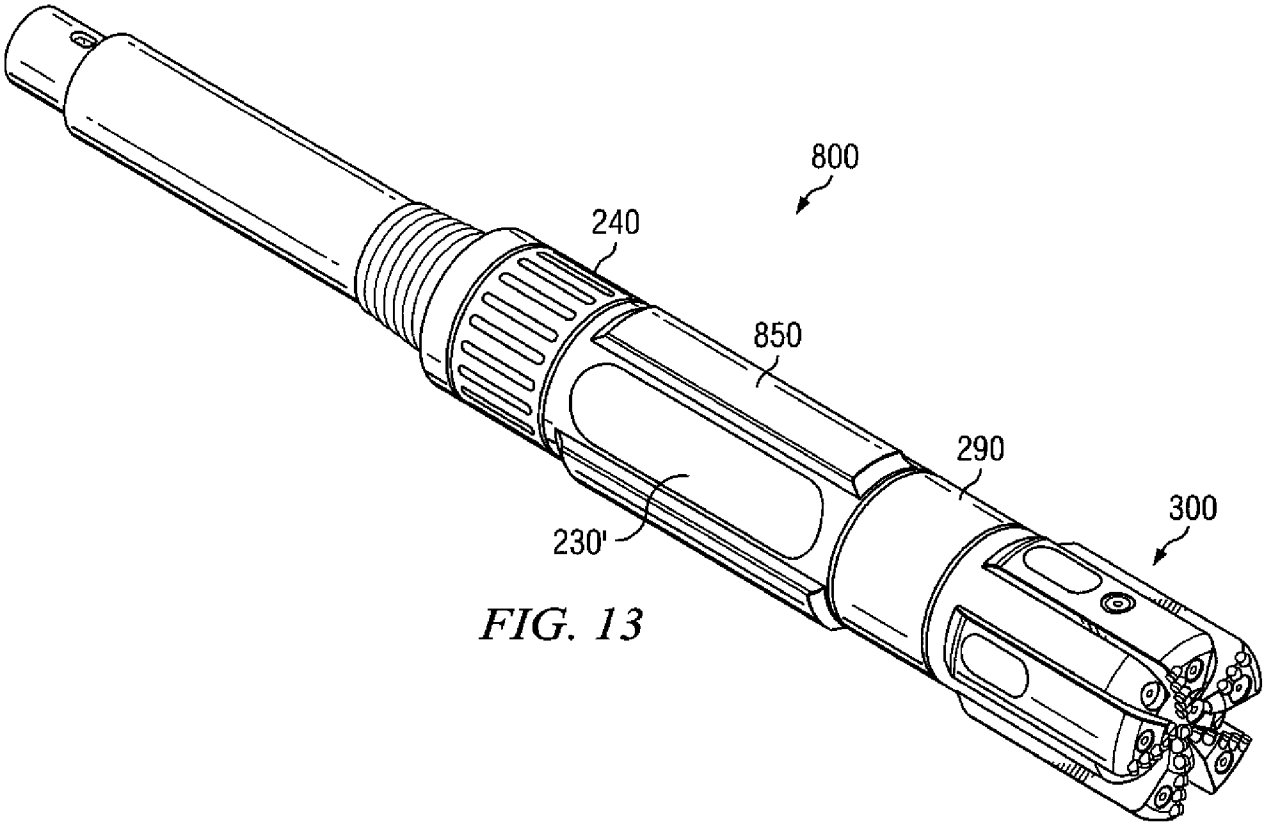
FIG. 13 depicts an isometric view of still another alternative embodiment of a drilling system in accordance with the present invention.

FIGS. 12 and 13 depict other alternative embodiments in accordance with the present invention configured for point-the-bit steering. These embodiments are configured to shorten the total length of the drilling system (as compared with the exemplary embodiment depicted on FIG. 2). Drilling system 700 (FIG. 12) is substantially identical to drilling system 100 with the exception that it makes use of very short near-bit stabilizer blades 750. Drilling system 800 (FIG. 13) is also substantially identical to drilling system 100 with the exception that it includes an integrated stabilizer section in which the near-bit stabilizer blades 850 and the chambers 230' are formed in the same axial region of the tool. Drilling systems 700 and 800 are shorter than drilling system 100 (FIG. 2) and may therefore provide a point-the-bit configuration better suited for drilling high dogleg severity boreholes.

It will be understood that that the exemplary drilling system embodiments depicted on FIGS. 2, 10, 11, 12, and 13 are by no means exhaustive. Those of ordinary skill in the art will readily be able to conceive of many other alternative embodiments that are within the scope of the invention. Moreover, it will further be understood that each of the embodiments depicted on FIGS. 2, 10, 11, 12, and 13 includes an integral logging while drilling tool and drill bit having a one-piece tool body. None of the embodiments depicted herein utilize a threaded connection between the drill bit and the LWD tool. These embodiments may also utilize a welded connection as described above with respect to FIG. 9.

Although the present invention and its advantages have been described in detail, it should be understood that various changes, substitutions and alternations can be made herein without departing from the spirit and scope of the invention as defined by the appended claims.

We claim:

1. A drilling system comprising:

a drill bit including a drill bit body having a plurality of cutting elements and at least a first logging while drilling sensor deployed therein;

a logging while drilling tool including a logging while drilling tool body having at least a second logging while drilling sensor deployed therein;

wherein the drill bit body and the logging while drilling tool body are integral and of a unitary construction, being formed from a single work piece such that they cannot be detached from one another.

2. The drilling system of claim 1, wherein the logging while drilling tool body further includes a plurality of near-bit stabilizer blades formed thereon.

3. The drilling system of claim 1, further comprising at least one longitudinal bore configured for housing electrical connectors, the longitudinal bore extending from the drill bit body to the logging while drilling tool body.

4. The drilling system of claim 1, wherein the first logging while drilling sensor comprises at least one current measuring electrode.

5. The drilling system of claim 4, further comprising a transmitter deployed on the logging while drilling tool body, the transmitter configured to induce an AC voltage difference in the tool body on opposing axial ends of the transmitter.

6. A drilling system comprising:

a drill bit including a drill bit body having a plurality of cutting blades formed on a cutting face thereof, each of the cutting blades including a plurality of cutting elements deployed thereon, the drill hit further including at least one current measuring electrode deployed on one of the cutting blades;

a logging while drilling tool including a logging while drilling tool body having a transmitter deployed thereon, the transmitter configured to induce an AC voltage difference in the tool body on opposing axial ends of the transmitter;

wherein the drill bit body and the logging while drilling tool body are integral and of a unitary construction, being formed from a single work piece such that they cannot be detached from one another.

7. The drilling system of claim 6, wherein the logging while drilling body further includes a plurality of near-bit stabilizer blades formed therein.

8. The drilling system of claim 6, wherein the drill bit further includes a pressure transducer deployed on one of the cutting blades.

9. The drilling system of claim 6, wherein the drill bit further includes at least one other current measuring electrode deployed on a lateral face of the drill bit body.

10. The drilling system of claim 6, wherein the drill bit body includes a plurality of sealed pockets formed therein, at least one of the pockets housing electrical circuitry configured to process measurements received from the current measuring electrode.

11. The drilling system of claim 6, further comprising a controller deployed in the logging while drilling tool body, the controller in electronic communication with the current measuring electrode.

12. The drilling system of claim 6, further comprising azimuthal gamma sensor deployed in the logging while drilling tool body.

13. The drilling system of claim 6, further comprising a directional sensor comprising at least one of a tri-axial accelerometer set and a tri-axial magnetometer set deployed in the logging while drilling tool body.

14. The drilling system of claim 6, further comprising battery pack deployed in the logging while drilling tool body.

15. The drilling system of claim 6, further comprising a short-hop communications antenna deployed on the logging while drilling tool body.

16. The drilling system of claim 6, wherein the current measuring electrode is deployed on a lateral face of the drill bit body and the drilling system further comprises:

a tool face sensor configured to measure a tool face of the current measuring electrode; and a controller configured to generate borehole images via correlating current measurements made by the current measurement electrode with tool face measurements made by the tool face sensor.

17. A drilling tool comprising:

an integral tool body including a drill bit body portion integral with a logging while drilling body portion, wherein the drill bit body portion and the logging while drilling tool body portion are of a unitary construction, being formed from a single work piece; and at least one logging while drilling sensor deployed in the drill bit body portion.

18. The drilling tool of claim 17, wherein:

the logging while drilling sensor comprises a current measuring electrode; and a transmitter is deployed on the logging while drilling tool body portion, the transmitter configured to induce an AC voltage difference in the tool body on opposing axial ends of the transmitter.

19. The drilling tool of claim 18, wherein the current measuring electrode is deployed on a lateral face of the drill bit body portion and the drilling tool further comprises:

a tool face sensor configured to measure a tool face of the current measuring electrode; and a controller configured to generate borehole images via correlating current measurements made by the current measurement electrode with tool face measurements made by the tool face sensor.

20. The drilling system of claim 17, wherein the logging while drilling body portion further comprises at least one of an azimuthal gamma sensor, a tri-axial accelerometer set, a tri-axial magnetometer set, a spectral density sensor, a neutron density sensor, a micro-resistivity sensor, an acoustic velocity sensor, an caliper sensor, a battery pack, and a short-hop communications antenna.

21. A method for fabricating a drilling system; the method comprising:

(a) forming a drilling system tool body from a single work piece, the drilling system tool body having a drill bit body portion and a logging while drilling body portion, the drill bit body portion being integral with the logging while drilling tool body portion such that the drill bit body portion cannot be detached from the logging while drilling tool body portion;

(b) deploying at least one logging while drilling sensor on the drill bit body portion; and (c) deploying at least one other logging while drilling sensor on the logging while drilling tool body.

22. The method of claim 21, wherein the bit body comprises a plurality of cutting blades formed on cutting face thereof and the method further comprises:

(d) deploying a plurality of cutting elements on each of the cutting blades.

23. A drilling system comprising:

a drill bit including a drill bit body having a plurality of cutting elements and at least a first logging while drilling sensor deployed therein;

a logging while drilling tool including a logging while drilling tool body having at least a second logging while drilling sensor deployed therein;

a welded connection at which the drill bit body is connected to the logging while drilling tool body; and wherein the drill bit body and the logging while drilling tool body are integral cannot be detached from one another.

24. The drilling system of claim 23, wherein the logging while drilling tool body further includes a plurality of near-bit stabilizer blades formed thereon.

25. The drilling system of claim 23, further comprising at least one longitudinal bore configured for housing electrical connectors, the longitudinal bore extending from the drill bit body to the logging while drilling tool body.

26. The drilling system of claim 23, wherein the first logging while drilling sensor comprises at least one current measuring electrode.

27. The drilling system of claim 26, further comprising a transmitter deployed on the logging while drilling tool body, the transmitter configured to induce an AC voltage difference in the tool body on opposing axial ends of the transmitter.

28. A drilling system comprising:

a drill bit including a drill bit body having a plurality of cutting blades formed on a cutting face thereof, each of the cutting blades including a plurality of cutting elements deployed thereon, the drill bit further including at least one current measuring electrode deployed on one of the cutting blades;

a logging while drilling tool including a logging while drilling tool body having a transmitter deployed thereon, the transmitter configured to induce an AC voltage difference in the tool body on opposing axial ends of the transmitter;

a welded connection at which the drill bit body is connected to the logging while drilling tool body; and wherein the drill bit body and the logging while drilling tool body are integral and cannot be detached from one another.

29. The drilling system of claim 28, wherein the logging while drilling body further includes a plurality of near-bit stabilizer blades formed therein.

30. The drilling system of claim 28, wherein the drill bit further includes a pressure transducer deployed on one of the cutting blades.

31. The drilling system of claim 28, wherein the drill bit further includes at least one other current measuring electrode deployed on a lateral face of the drill bit body.

32. The drilling system of claim 28, wherein the drill bit body includes a plurality of sealed pockets formed therein, at least one of the pockets housing electrical circuitry configured to process measurements received from the current measuring electrode.

33. The drilling system of claim 28, further comprising a controller deployed in the logging while drilling tool body, the controller in electronic communication with the current measuring electrode.

34. The drilling system of claim 28, further comprising an azimuthal gamma sensor deployed in the logging while drilling tool body.

35. The drilling system of claim 28, further comprising a directional sensor comprising at least one of a tri-axial accelerometer set and a tri-axial magnetometer set deployed in the logging while drilling tool body.

36. The drilling system of claim 28, further comprising a battery pack deployed in the logging while drilling tool body.

37. The drilling system of claim 28, further comprising a short-hop communications antenna deployed on the logging while drilling tool body.

38. The drilling system of claim 28, wherein the current measuring electrode is deployed on a lateral face of the drill bit body and the drilling system further comprises:

a tool face sensor configured to measure a tool face of the current measuring electrode; and a controller configured to generate borehole images via correlating current measurements made by the current measurement electrode with tool face measurements made by the tool face sensor.

39. A drilling tool comprising:

an integral tool body including a drill bit body portion integral with a logging while drilling body portion such that the drill bit body portion cannot be detached from the logging while drilling body portion;

a welded connection at which the drill bit body portion is connected to the logging while drilling tool body portion; and at least one logging while drilling sensor deployed in the drill bit body portion.

40. The drilling tool of claim 39, wherein:

the logging while drilling sensor comprises a current measuring electrode; and a transmitter is deployed on the logging while drilling tool body portion, the transmitter configured to induce an AC voltage difference in the tool body on opposing axial ends of the transmitter.

41. The drilling tool of claim 40, wherein the current measuring electrode is deployed on a lateral face of the drill bit body portion and the drilling tool further comprises:

a tool face sensor configured to measure a tool face of the current measuring electrode; and a controller configured to generate borehole images via correlating current measurements made by the current measurement electrode with tool face measurements made by the tool face sensor.

42. A method for fabricating a drilling system; the method comprising:

(a) forming a drill bit body portion;

(b) forming a logging while drilling body portion;

(c) welding the drill bit body portion and the logging while drilling body portion to one another to form a drilling system tool body in which the drill bit body portion is integral with the logging while drilling tool body portion such that the drill bit body portion cannot be detached from the logging while drilling tool body portion;

(d) deploying at least one logging while drilling sensor on the drill bit body portion; and (e) deploying at least one other logging while drilling sensor on the logging while drilling tool body.

43. The method of claim 42, wherein the bit body comprises a plurality of cutting blades formed on cutting face thereof and the method further comprises: (d) deploying a plurality of cutting elements on each of the cutting blades.

* * * * *